US005967639A

United States Patent [19]

Shih

[11] Patent Number: 5,967,639

[45] Date of Patent: Oct. 19, 1999

[54] LIQUID HOLDING ORNAMENT INCLUDING AN AIR PUMP AND A PROJECTION LAMP

[76] Inventor: Hsueh-Ming Shih, No. 239, Hsin Ming Rd., Nei Hu Dist., Taipei, Taiwan

[21] Appl. No.: 09/015,773

[22] Filed: Jan. 29, 1998

[51] Int. Cl.[6] ..... F21V 3/300

[52] U.S. Cl. ..... 362/101; 362/96; 362/806

[58] Field of Search ..... 362/96, 101, 562, 362/811, 806

[56] References Cited

U.S. PATENT DOCUMENTS

| | | | |
|---|---|---|---|
| 4,072,855 | 2/1978 | Marchese | 362/101 |
| 4,170,035 | 10/1979 | Walker | 362/96 X |
| 4,609,974 | 9/1986 | Mori | 362/101 X |
| 4,858,083 | 8/1989 | Wakimoto | 362/101 |
| 4,967,321 | 10/1990 | Cimock | 362/101 |
| 5,211,469 | 5/1993 | Matthias et al. | 362/806 X |
| 5,803,580 | 9/1998 | Tseng | 362/811 X |

*Primary Examiner*—Laura K. Tso
*Attorney, Agent, or Firm*—Bacon & Thomas, PLLC

[57] ABSTRACT

A dynamic display ornament includes at least one transparent display device, each display device holding a liquid and having a top opening and a bottom air inlet,a box-like base which supports the at least one transparent display device, at least one projection lamp mounted inside the base and controlled to project light vertically through the bottom side of each of the at least one transparent display device, and air pump means mounted inside the base and controlled to pump air into the air inlet at the bottom side of each of the at least one display device, causing bubbles to be produced in the liquid in each display device.

11 Claims, 5 Drawing Sheets

LIQUID HOLDING ORNAMENT INCLUDING AN AIR PUMP AND A PROJECTION LAMP

BACKGROUND OF THE INVENTION

The present invention relates to a display ornament, and more particularly a dynamic display ornament that can be put in a public place or home at the entrance for decoration.

Antiques and paintings are commonly used to decorate a room, house, or particular place. However, these ornaments are static decorations that are not suitable for some particular business places. Furthermore, these ornaments are commonly expensive.

SUMMARY OF THE INVENTION

The present invention provides a dynamic display ornament which comprises a base, and a display device supported on the base. The display device is a transparent liquid container holding a colored liquid. The base holds a projection lamp which is controlled to project light through the display device, and an air pump which pumps air into the display device, causing bubbles to be produced in the liquid contained in the display device.

DETAILED DESCRIPTION OF THE PREFERRED EMBODIMENT

Figure 1:
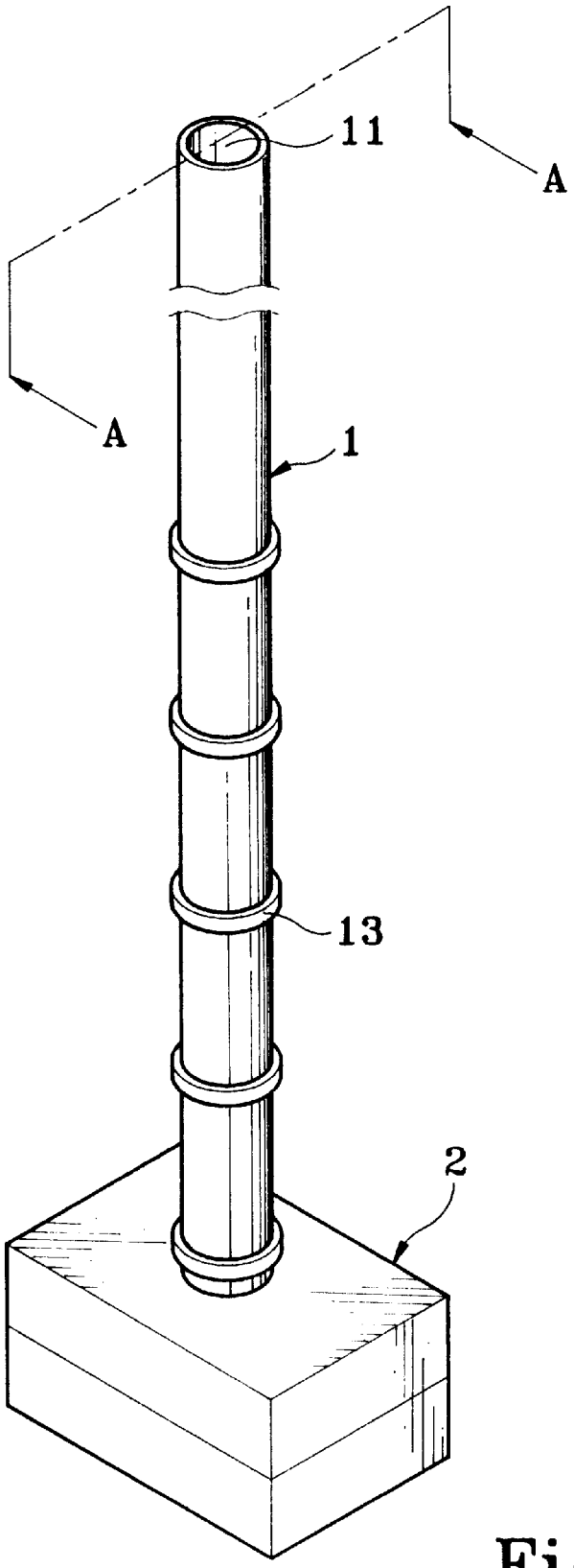
FIG. 1 is an elevational view of a display ornament according to the present invention.
Figure 2:
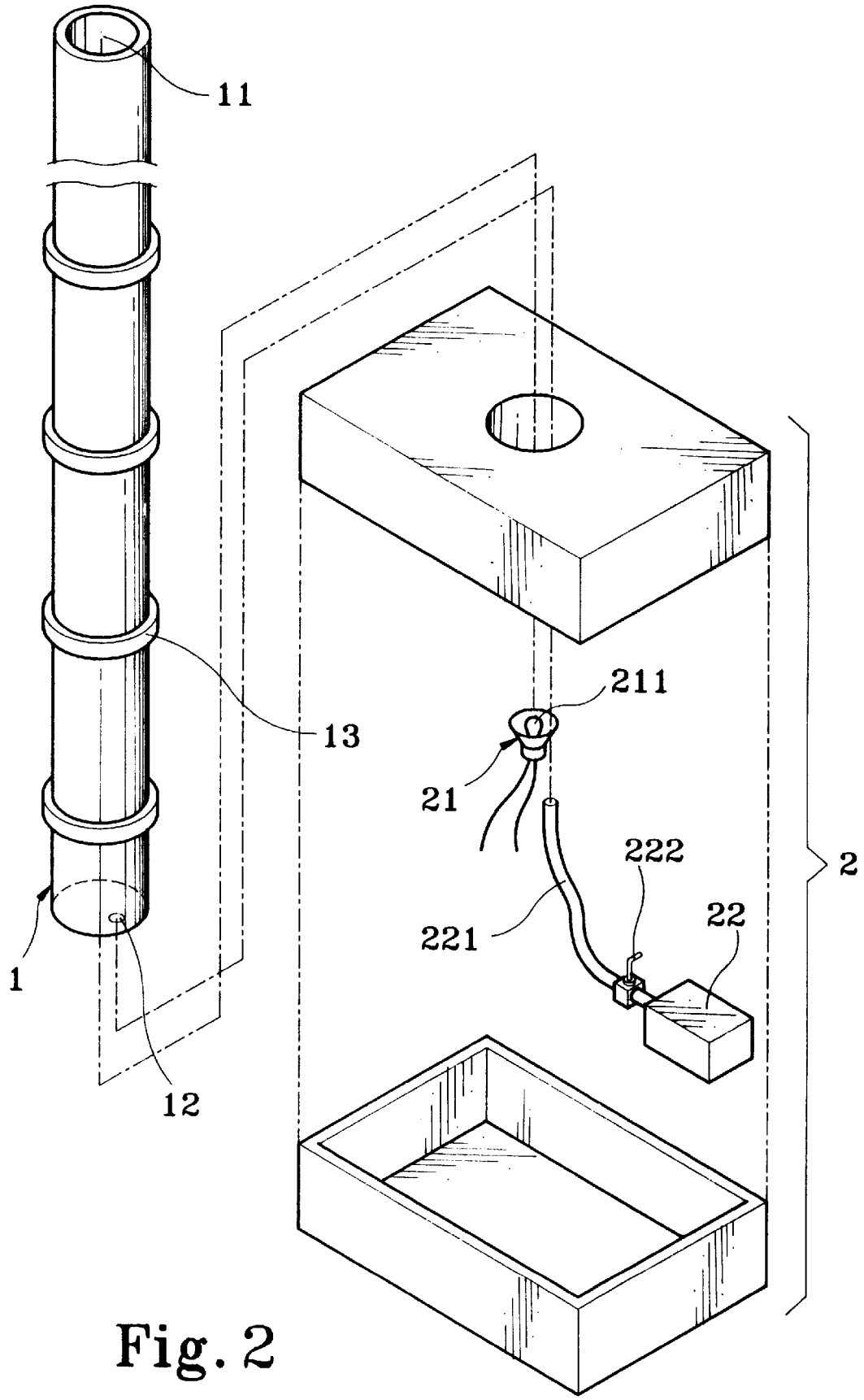
FIG. 2 is an exploded view of the dynamic display ornament shown in FIG. 1.
Figure 3:
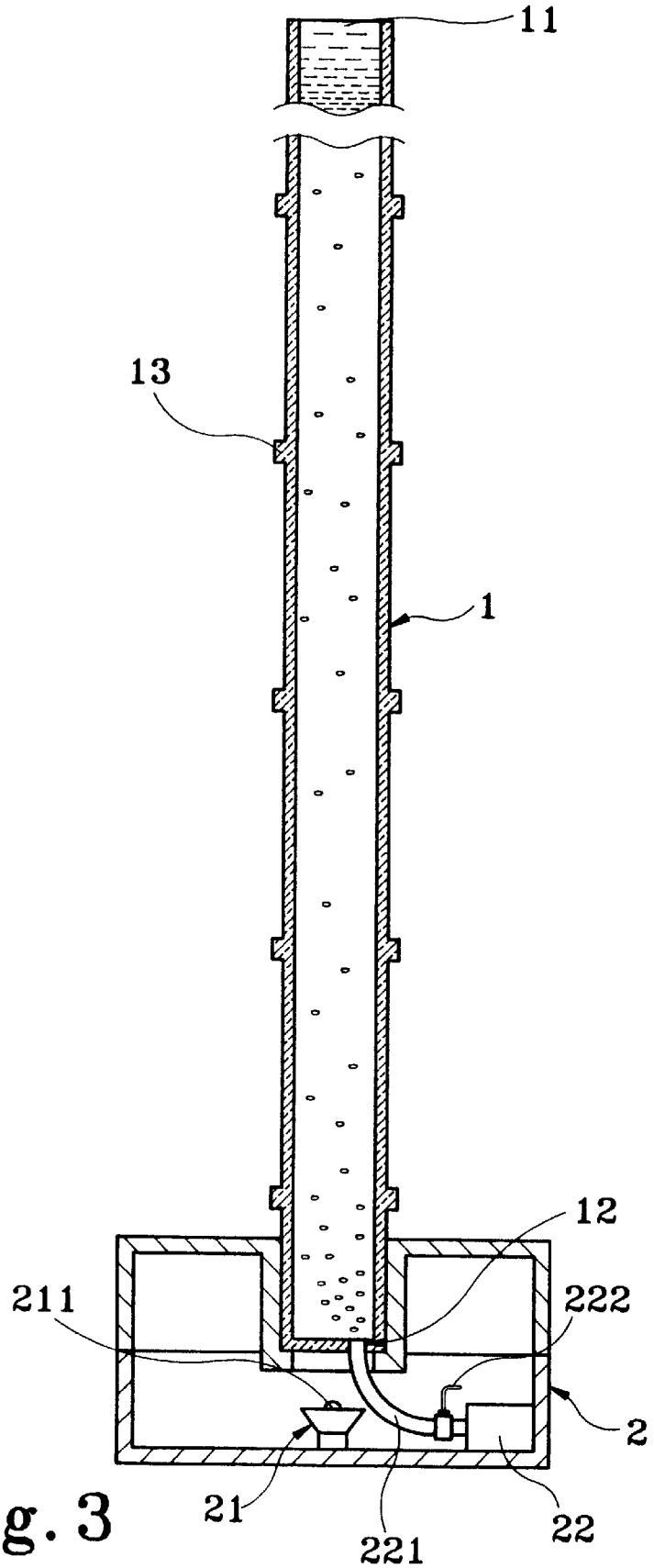
FIG. 3 is a sectional view taken along line A—A of FIG. 1.

Referring to FIGS. 1, 2 and 3, a display ornament in accordance with the preferred embodiment of the present invention is generally comprised of a transparent display device 1, and a box-like base 2 at the bottom side of the transparent display device 1.

The transparent display device 1 is a hollow member holding a colored liquid, having a top opening 11, and a bottom air inlet 12.

The box-like base 2 holds a projection lamp 21 and an air pump means (for example, an air compressor) 22 on the inside. The light emitting element 211 of the projection lamp 21 is aimed at the bottom side of the display device 1, and controlled to project light upwardly through the display device 1, permitting light to be refracted by the colored liquid in the display device 1 in different directions. The air pump means 22 has an output port connected to the air inlet 12 on the display device 1 through an air tube 221. When the air pump means 22 is started, air is forced into the display device 1, thereby causing bubbles to be produced in the colored liquid in the display device 1 (see FIG. 3). A regulating valve 222 is provided at the air tube 221 for regulating the flow rate of air passing through. When operated, bubbles are continuously produced in the display device 1, and light rays from the projection light 21 are refracted by the colored liquid in the display device 1 and the bubbles therein in different directions, producing a fantastic lighting effect.

Figure 4:
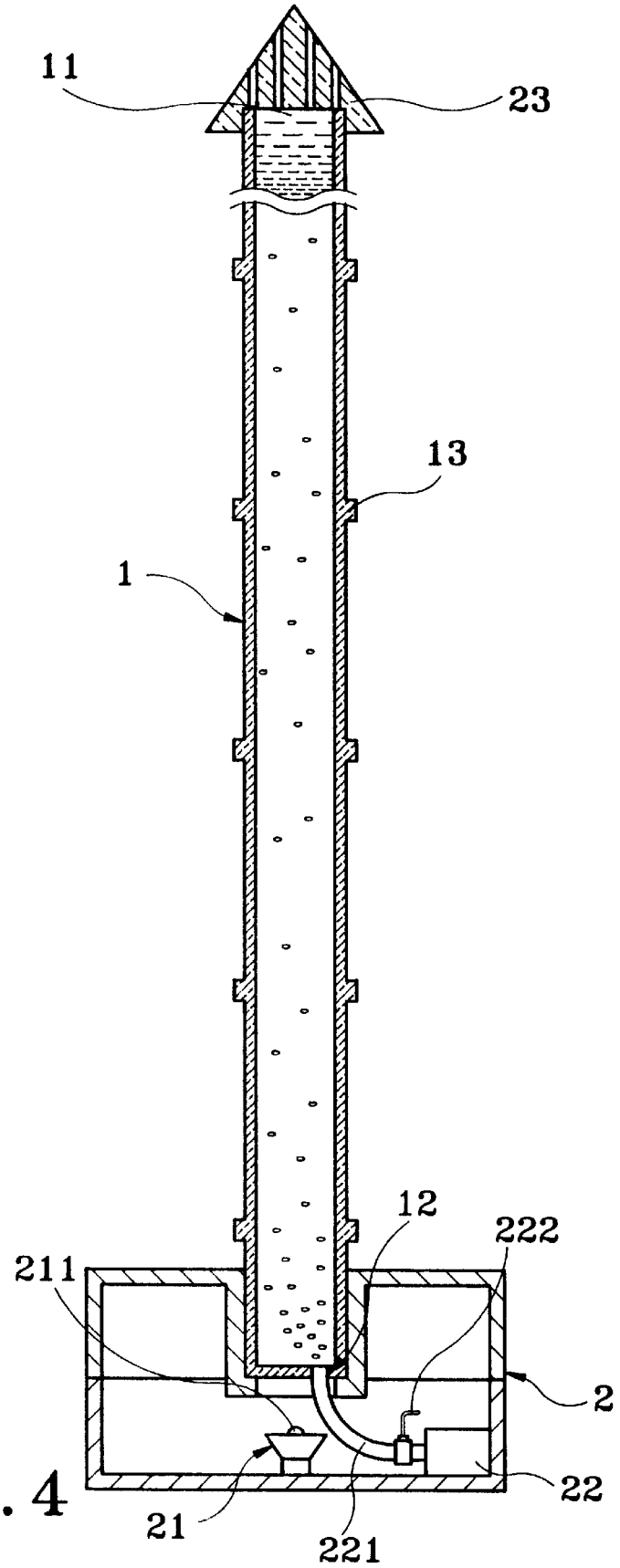
FIG. 4 is a sectional view of an alternate form of the present invention, showing an ornamental cap provided at the top side of the display device.

Referring to FIG. 4, an ornamental cap 23 is provided at the top side of the display device 1 and covered over the top opening 11. The ornamental cap 23 has air vents through which air passes out of the top opening 11 of the display device 1. Further, decorative rings 13 are mounted around the periphery of the display device 1 at different elevations. The outside wall of the display device 1 may be processed into light refracting planets, light refracting convex portions, or light refracting concave-convex portions. The display device 1 can have any of a variety of designs, for example, the display device 1 can be shaped like a tree, an animal, etc.

Figure 5:
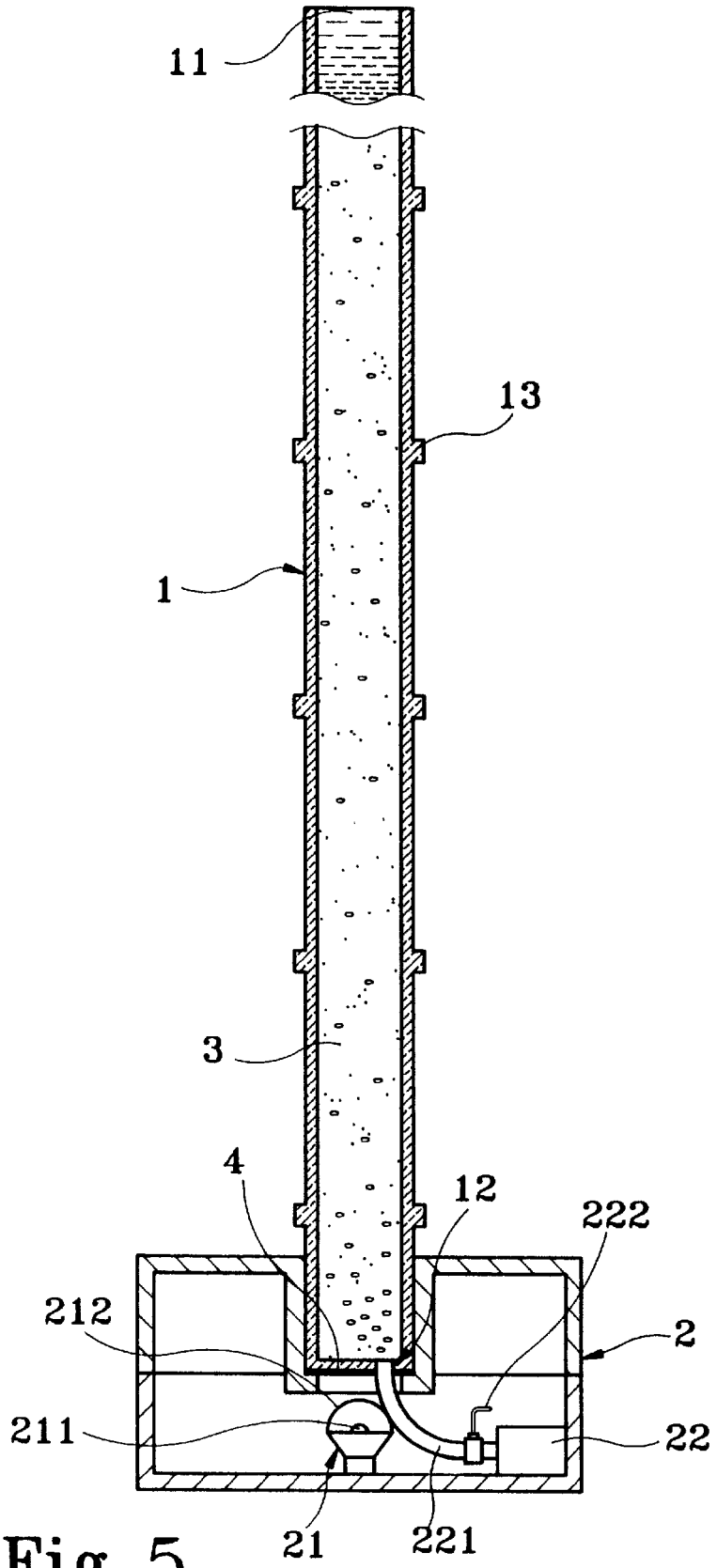
FIG. 5 is a sectional view of another alternate form of the present invention, showing a color filter mounted on the bottom side of the display device and a lampshade that covers the projection lamp.

Referring to FIG. 5, the display device 1 can be colored, or colored light reflecting chips 3 may be put in the colored liquid in the display device 1, or a color filter 4 may be covered on the bottom side of the display device 1. Further, the light emitting element 211 can be a incandescent bulb or a light emitting diode, and a colored lampshade 212 may be provided to cover the light emitting element 211. The projection lamp 21 may be comprised of a plurality of color light emitting diodes that produce different colors of light.

It is to be understood that the drawings are designed for purposes of illustration only, and are not intended as a definition of the limits and scope of the invention disclosed.

What the invention claimed is:

1. A dynamic display ornament comprising:

at least one transparent display device, each of said at least one transparent display device holding a liquid and having a top side, a bottom side, an opening at said top side, and an air inlet at said bottom side;

a box-like base which supports said at least one transparent display device;

at least one projection lamp mounted inside said box-like base and controlled to project light vertically through the bottom side of each of said at least one transparent display device; and air pump means having an air output port respectively connected to the air inlet at the bottom side of each of said at least one display device by a respective air tube, and controlled to pump air into the air inlet at the bottom side of each of said at least one display device.

2. The dynamic display ornament of claim 1, wherein a plurality of ornamental rings are mounted around the periphery of each of said at least one display device.

3. The dynamic display ornament of claim 1, whrein said air pump means comprises regulating valve means for regulating the flow rate of output air.

4. The dynamic display ornament of claim 1, wherein each of said at least one display device is decorated with an ornamental cap at the top side thereof.

5. The dynamic display ornament of claim 1, wherein a plurality of color light reflecting chips are put in the liquid contained in each of said at least one display device.

6. The dynamic display ornament of claim 1, wherein the bottom side of each of said at least one display device is covered with a color filter.

7. The dynamic display ornament of claim 1, wherein said at least one display device is respectively made of colored material.

8. The dynamic display ornament of claim 1, wherein said at least one projection lamp is comprised of at least one incandescent bulb.

9. The dynamic display ornament of claim 8, wherein said at least one projection includes a lampshade that covers said at least one incandescent bulb.

10. The dynamic display ornament of claim 1, wherein said at least one projection lamp is comprised of at least one light emitting diode.

11. The dynamic display ornament of claim 10, wherein each of said at least one projection lamp is mounted with a colored lampshade covered over the respective at least one light emitting diode.

* * * * *

US005967639C1

(12) EX PARTE REEXAMINATION CERTIFICATE (5429th)

United States Patent
Shih

(10) Number: US 5,967,639 C1
(45) Certificate Issued: Jun. 27, 2006

(54) LIQUID HOLDING ORNAMENT INCLUDING AN AIR PUMP AND A PROJECTION LAMP

(75) Inventor: Hsueh-Ming Shih, Taipei (TW)

(73) Assignee: Homedics-USA, Inc., Commerce Township, MI (US)

Reexamination Request:
No. 90/006,129, Oct. 15, 2001

Reexamination Certificate for:

| | |
|---|---|
| Patent No.: | **5,967,639** |
| Issued: | **Oct. 19, 1999** |
| Appl. No.: | **09/015,773** |
| Filed: | **Jan. 29, 1998** |

(51) Int. Cl.
*F21V 33/00* (2006.01)

(52) U.S. Cl. ..... 362/101; 362/96; 362/806
(58) Field of Classification Search ..... None
See application file for complete search history.

(56) References Cited

U.S. PATENT DOCUMENTS 1,080,340 A 12/1913 Heissenbuttel
4,074,165 A * 2/1978 Moriyama ..... 362/311
4,703,720 A 11/1987 Shipman et al.
5,624,177 A * 4/1997 Rosaia ..... 362/101
5,980,063 A * 11/1999 Ford et al. ..... 362/186

FOREIGN PATENT DOCUMENTS

SU 1142697 A 2/1985

* cited by examiner

*Primary Examiner*—Thomas Sember

(57) ABSTRACT

A dynamic display ornament includes at least one transparent display device, each display device holding a liquid and having a top opening and a bottom air inlet,a box-like base which supports the at least one transparent display device, at least one projection lamp mounted inside the base and controlled to project light vertically through the bottom side of each of the at least one transparent display device, and air pump means mounted inside the base and controlled to pump air into the air inlet at the bottom side of each of the at least one display device, causing bubbles to be produced in the liquid in each display device.

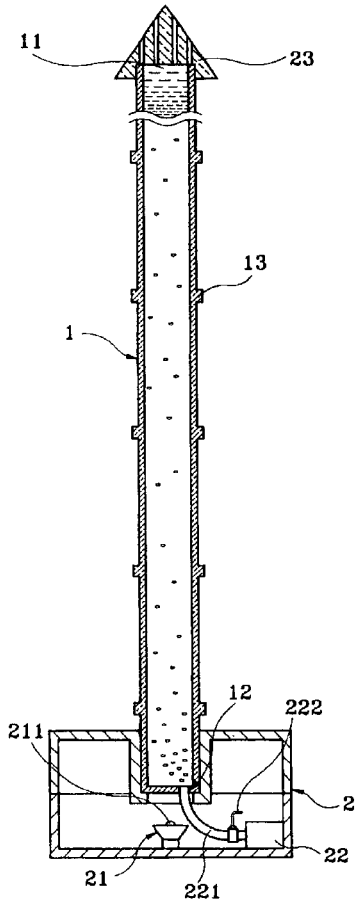

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–11 are cancelled.

* * * * *